US007455751B2

(12) United States Patent
Ward et al.

(10) Patent No.: US 7,455,751 B2
(45) Date of Patent: Nov. 25, 2008

(54) USE OF ALKENYL SUCCINIC ANHYDRIDE COMPOUNDS DERIVED FROM SYMMETRICAL OLEFINS IN INTERNAL SIZING FOR PAPER PRODUCTION

(75) Inventors: William J. Ward, Glen Ellyn, IL (US); Krzysztof Andruszkiewicz, Gdynia (PL); Ross T. Gray, Plainfield, IL (US); Timothy Patrick McGinnis, Wheaton, IL (US); Robert W. Novak, Lisle, IL (US)

(73) Assignee: Nalco Company, Naperville, IL (US)

( * ) Notice: Subject to any disclaimer, the term of this patent is extended or adjusted under 35 U.S.C. 154(b) by 457 days.

(21) Appl. No.: 11/107,045

(22) Filed: Apr. 15, 2005

(65) Prior Publication Data

US 2006/0231223 A1 Oct. 19, 2006

(51) Int. Cl.

| | |
|---|---|
| ***D21H 21/16*** | (2006.01) |
| ***D21H 23/22*** | (2006.01) |
| ***D21H 23/24*** | (2006.01) |
| ***C07D 307/60*** | (2006.01) |

(52) U.S. Cl. ..... 162/158; 162/184; 162/185; 549/233; 549/255

(58) Field of Classification Search ..... 162/158, 162/184, 185; 549/233, 255

See application file for complete search history.

(56) References Cited

U.S. PATENT DOCUMENTS

| | | | | |
|---|---|---|---|---|
| 3,102,064 | A | 8/1963 | Wurzburg et al. | |
| 3,821,069 | A | 6/1974 | Wurzburg | |
| 4,040,900 | A * | 8/1977 | Mazzarella et al. | 162/158 |
| 4,302,283 | A * | 11/1981 | Blitzer et al. | 162/158 |
| 4,629,655 | A * | 12/1986 | Winters et al. | 428/402 |
| 5,021,169 | A | 6/1991 | Shin et al. | |
| 5,603,997 | A * | 2/1997 | Lindgren et al. | 428/34.2 |
| 6,348,132 | B1 | 2/2002 | Zhang et al. | |
| 2003/0224945 | A1 | 12/2003 | Twu et al. | |

OTHER PUBLICATIONS

R.J. Proverb et al., "Chemical Optimization of the ASA Sizing System", 1989 Papermakers Conference, TAPPI Proceedings (1989).

Smith, D., "ASA Components: Their Synthesis and Relative Sizing Performance", Scientific and Technical Advances in the Internal and Surface Sizing of Paper and Board, Pira International of Leatherhead, Surrey, UK, pp. 1-13, Dec. 1999.

* cited by examiner

*Primary Examiner*—Eric Hug
*Assistant Examiner*—Dennis Cordray
(74) *Attorney, Agent, or Firm*—Michael B. Martin; Benjamin E. Carlsen

(57) ABSTRACT

A method of sizing paper for use in applications which require resistance to liquids comprising incorporating in the paper a size composition comprising one or more alkenyl succinic anhydride (ASA) compounds prepared from the reaction of maleic anhydride and one or more substantially symmetrical $C_{20}$-$C_{28}$ internal olefins.

12 Claims, No Drawings

USE OF ALKENYL SUCCINIC ANHYDRIDE COMPOUNDS DERIVED FROM SYMMETRICAL OLEFINS IN INTERNAL SIZING FOR PAPER PRODUCTION

TECHNICAL FIELD

This invention relates to a method of sizing paper products using alkenyl succinic anhydride compounds, more particularly, alkenyl succinic anhydride compounds prepared from maleic anhydride and substantially symmetrical $C_{20}$-$C_{28}$ internal olefins.

BACKGROUND OF THE INVENTION

The use of alkenyl succinic anhydride (ASA) materials in internal paper sizing is well established, and the volume of these types of products used worldwide is very large. ASA materials are used to impart a degree of hydrophobicity to the paper fibers during production, and an overall resistance to liquid absorption to the finished paper product.

ASA is most commonly produced by the high temperature reaction of maleic anhydride (MA) and a long chain internal olefin. The olefin to MA mole ratio is usually greater than 1.0. The type of olefin used to produce the ASA can have a significant impact on product performance. The olefins employed in commercial ASA sizes typically contain a carbon chain length of 16-18.

It is also known that the degree of linearity of the olefin and the position of the double bond in the olefin can impact performance. For example, in general 'isomerized' olefins are used over alpha olefins. The isomerized olefins are generated by heating an alpha olefin in the presence of a suitable catalyst to move the double bond from the terminal position of the olefin to an internal position. Typically, the isomerization process creates a complex mixture of various olefin isomers. The main reason that isomerized olefins are used is the observed increase in ASA performance, and the creation of a liquid form of ASA (as opposed to a more crystalline or solid product).

ASA compounds prepared from maleic anhydride and various internal olefins are disclosed in U.S. Pat. No. 3,821,069. ASA compounds prepared from maleic anhydride and mixtures of olefins, including internal olefins, are disclosed in U.S. Pat. No. 6,348,132. The preparation of internal olefins by a metathesis reaction and a utility of the metathesized olefins in the preparation of ASA compounds are disclosed in U.S. Patent Application No. 2003/0224945 A1. A purported relationship between double bond position and carbon chain length in olefins used to prepare ASA compounds is discussed in Smith, D., "ASA Components: Their Synthesis and Relative Sizing Performance" in *Proceedings of Scientific & Technical Advances in the Internal & Surface Sizing of Paper & Board*, Florence, Italy, Pira International (1999).

Commercial ASA compounds are typically prepared from maleic anhydride and $C_{16}$ internal olefins, $C_{18}$ internal olefins and mixtures of $C_{16}$ and $C_{18}$ internal olefins. However, as discussed herein, these ASA compounds are often unsuitable for sizing paper products that require resistance to aggressive liquids. Accordingly, there is an ongoing need for improved sizing products for this application, particularly for sizing products that do not require co-administration of additional products such as alkyl ketene dimer (AKD) or rosin sizes.

SUMMARY OF THE INVENTION

This invention is a method of imparting resistance of paper to penetration by liquids comprising incorporating in the paper a size composition comprising one or more alkenyl succinic anhydride (ASA) compounds prepared from the reaction of maleic anhydride and one or more substantially symmetrical $C_{20}$-$C_{28}$ internal olefins, or a mixture thereof.

DETAILED DESCRIPTION OF THE INVENTION

The preparation of ASA sizes by the ene reaction of maleic anhydride and olefins is well known. The ASA compound of this invention may be prepared by heating a symmetrical or substantially symmetrical $C_{20}$-$C_{28}$ internal olefin, or a mixture thereof, with maleic anhydride. The mole ratio of olefin to maleic anhydride is typically about 1/1 to about 2/1. The reagents are stirred and heated in an inert atmosphere at a temperature of about 180° C. to about 230° C. for several hours. A small amount (<1%) of a suitable antioxidant is sometimes added to the mixture to reduce unwanted side reactions and reduce the overall color of the final product. After the reaction is completed, any residual maleic anhydride and excess olefin reagent is removed via vacuum distillation, which gives the desired ASA product.

Substantially symmetrical internal olefins suitable for preparing the ASA compound of this invention are olefins in which the carbon-carbon double bond is situated within one carbon atom of the center of the hydrocarbon chain. "Linear internal olefin" means a substantially symmetrical internal olefin as defined herein in which the alkyl groups on each side of the double bond are linear.

Representative suitable substantially symmetrical internal olefins include 10-eicosene, 11-docosene, 12-tetracosene, 13-hexacosene, 14-octacosene, 9-eicosene, 10-heneicosene, 10-docosene, 11-tetracosene, 11-tricosene, 12-hexacosene, 12-pentacosene, 13-octacosene, 13-heptacosene, and the like.

In an embodiment, the substantially symmetrical internal olefm is an olefin of formula $R_1CH{=}CHR_2$ wherein $R_1$ and $R_2$ are selected from the group consisting of linear or branched $C_9$-$C_{13}$ alkyl and $R_1$ and $R_2$ are the same, hereinafter "symmetrical internal olefin".

Suitable substantially symmetrical internal olefins are conveniently produced using a metathesis process. In this case, an alpha olefm is stirred and reacted in the presence of a metathesis catalyst. The metathesis catalyst can be oxides or organometallic materials based on various transition metals such as titanium, tungsten, rhenium, or especially ruthenium (Grubbs catalysts). The olefin can be heated or reacted at mild temperatures (depending on the catalyst and amount). The metathesis reaction is reversible and is dictated by equilibrium conditions. In the case of alpha olefins, ethylene gas is generated and is removed to push the reaction equilibrium forward. For example the reaction of $C_{12}$ alpha olefin with the appropriate metathesis catalyst would yield 11-docosene along with ethylene gas. The catalyst system can be homogeneous or non-homogeneous, continuous (fixed bed) or batch. See 'Olefin Metathesis and Metathesis Polymerization' by J. K. Mol (Published 1997).

In an embodiment, the alkenyl succinic anhydride compound is prepared by reaction of maleic anhydride and one or more linear substantially symmetrical $C_{20}$-$C_{28}$ internal olefins.

In another embodiment, the alkenyl succinic anhydride compound is prepared by reaction of maleic anhydride and one or more symmetrical $C_{20}$-$C_{28}$ internal olefins.

In another embodiment, the alkenyl succinic anhydride compound is prepared by reaction of maleic anhydride and one or more substantially symmetrical $C_{22}$-$C_{28}$ internal olefins.

In another embodiment, the alkenyl succinic anhydride compound is prepared by reaction of maleic anhydride and one or more linear, substantially symmetrical $C_{22}$-$C_{28}$ internal olefins.

In another embodiment, the alkenyl succinic anhydride compound is prepared by reaction of maleic anhydride and one or more linear, symmetrical $C_{22}$-$C_{28}$ internal olefins.

In another embodiment, the alkenyl succinic anhydride compound is the reaction product of maleic anhydride and 11-docosene.

The ASA size of this invention is useful in all grades of paper that require resistance to the penetration of liquids (i.e. dairy products, citrus juices, oils, water, and inks). In an embodiment, the paper is selected from the group consisting of gypsum wall board liner, boxboard, liquid packaging board, folding carton, cup stock, sack paper, molded paper products, newspaper and printing paper.

In another embodiment, the paper is liquid packaging board.

In another embodiment, the paper is gypsum wallboard liner.

In another embodiment, the paper is folding carton or cup stock.

Liquid packaging board (LPB) typically is a paper-based board that is laminated on both sides with polyethylene. It is used to construct cartons that contain liquid beverages like milk and juice. The polyethylene coating prevents the penetration of liquid into the carton, resulting in its weakening and destruction. However, the LPB is still susceptible to liquid penetration due to imperfections in the polyethylene coating and, particularly, at the cut edges of the folded carton. Sizing chemicals must be added to the paperboard in order to prevent the penetration of liquids into this cut edge.

The most common liquids packaged in LPB are dairy products like milk and cream. These products contain lactic acid. It is difficult to prevent edge penetration by dairy products. It is well known that alkyl ketene dimer (AKD) size provides excellent resistance to edge penetration by lactic acid solutions when the paperboard is produced under alkaline conditions with a pH of 7 to 8.5. Rosin size and commercially available ASA size are not able to provide adequate lactic acid resistance.

Perishable liquids that do not require refrigeration are also packaged in LPB. These aseptic packages must be sterilized by soaking in a hot hydrogen peroxide solution prior to filling. AKD sizing does not provide adequate resistance to the edge penetration of hydrogen peroxide solutions during sterilization. The use of rosin size in paperboard produced using acid conditions (pH between 4 and 6) with the use of alum as a fixing agent is able to provide sufficient hydrogen peroxide resistance.

Thus, preventing edge penetration in aseptic packaging board cannot be accomplished with a single known sizing agent. However, a combination program of AKD and rosin is proposed in U.S. Pat. No. 4,927,496 and is used commercially today. This program requires the pH adjustment of the pulp slurry to approximately 5.0 prior to rosin addition. The pH of the pulp must then be increased to about 7.0 prior to AKD addition. This strategy is complex and difficult to control. If the final pH drifts below 7, lactic acid resistance suffers due to poor AKD performance. If the final pH drifts above 7, hydrogen peroxide resistance suffers due to poor rosin performance. Thus, excess chemicals are often added, leading to poor drainage and deposition on the paper machine. This program also suffers from the problems typically associated with AKD use like poor polyethylene adhesion, foaming, and delayed development of the sizing response.

The ASA compounds of the present invention may be used as an internal size or a surface size. Surface sizes are applied as a liquid solution or dispersion to the dry sheet, usually in a size press or at the calender stack. In a simple puddle-type size press, the paper sheet runs through a pond or puddle of sizing solution and into a nip formed between two press rolls. The size solution is sprayed into the nip on each side of the sheet and the nip forces the sizing solution into the sheet.

Internal sizes are added to the papermaking furnish in the wet end of the paper machine, prior to the headbox and the start of the dewatering process. They are retained in the sheet of paper through the use of their emulsification polymers and/or typical retention and drainage additives like coagulants and flocculants.

Internal sizes may also be sprayed on the surface of the sheet after formation of the wet web, for example using a spray boom with appropriately placed nozzles across the width of the papermachine. The spray nozzles are designed and spaced to ensure even distribution of compound on the sheet without disruption of the fibrous mat. The placement of the spray boom on the machine may be anywhere along the length of the forming zone where gravity and vacuum dewatering occurs or immediately prior to the press section or the dryer section. A commonly used location for spraying chemical additives onto a paper sheet is between the wet line and the couch roll of a Fourdrinier-type papermachine. The wet line is the location where the appearance of the wet web changes from a glossy, reflective surface to that of a dry, matte surface.

The ASA composition of this invention may be used in combination with one or more materials that are cationic in nature or capable of ionizing or dissociating in such a manner as to produce one or more cations or other positively charged moieties. Such cationic agents have been found useful as a means for aiding in the retention of sizing compositions. Among the materials that may be employed as cationic agents in the sizing process are, for example, alum, aluminum chloride, long chain fatty amines, sodium aluminate, substituted polyacrylamide, chromic sulfate, animal glue, cationic thermosetting resins and polyamide polymers. Particularly suitable cationic agents include, for example, cationic starch derivatives, including primary, secondary, tertiary or quaternary amine starch derivatives and other cationic nitrogen substituted starch derivatives, as well as cationic sulfonium and phosphonium starch derivatives. Such derivatives may be prepared from all types of starches including corn, tapioca, potato, waxy maize, wheat and rice. Moreover, they may be in their original granule form or they may be converted to pregelatinized, cold water soluble products and/or employed in liquid form.

The cationic agents may be added to the stock, i.e., the pulp slurry, either prior to, along with, or after the addition of the sizing composition. To achieve maximum distribution, it may be preferable to add the cationic agent subsequent to or in combination with the sizing composition. The addition to the stock of the sizing compositions and/or cationic agent may take place at any point in the paper making process prior to the ultimate conversion of the wet pulp into a dry web or sheet. Thus, for example, the present sizing compositions may be added to the pulp while the latter is in the headbox, beater, hydropulper and/or stock chest.

To obtain advantageous sizing, it is generally desirable to uniformly disperse the sizing agents throughout the fiber slurry in as small a particle size as possible, preferably smaller than 2 micron. This may be achieved, for example, by emulsifying the sizing compositions prior to addition to the stock utilizing mechanical means such as, for example, high speed agitators, mechanical homogenizers, and/or through the addition of a suitable emulsifying agent. Suitable emulsifying agents include, for example, cationic agents as described above, as well as non-cationic emulsifiers including, for example, hydrocolloids such as ordinary starches, non-cationic starch derivatives, guar gums, dextrines, carboxymethyl cellulose, gum arabic, gelatin, and polyvinyl alcohol, as well as various surfactants. Examples of suitable surfactants include, for example, polyoxyethylene sorbitan trioleate, polyoxyethylene sorbitol hexaoleate, polyoxyethylene sorbitol laurate, polyoxyethylene sorbitol oleate-laurate, sodium dioctyl sulfosuccinate, and polyoxyethylene alkyl phosphate. When such non-cationic emulsifiers are used, it may be desirable to separately add a cationic agent to the pulp slurry after the addition of the emulsified sizing agent. In preparing these emulsions with the use of an emulsifier, the latter may be first dispersed in water and the sizing composition may then be introduced along with vigorous agitation. Alternatively, the emulsification techniques described, for example, in U.S. Pat. No. 4,040,900, incorporated herein by reference, may be employed.

In certain circumstances, further improvements in the water resistance of the paper prepared with the sizing compositions of this invention may be obtained, for example, by curing the resulting webs, sheets, or molded products. This curing process may involve heating the paper to a temperature and for a time suitable to obtain the desired improved water resistance, typically by heating the paper to temperatures between about 80° C. and 150° C. for about 1 to about 60 minutes.

The sizing compositions of the present invention are useful for the sizing of paper prepared from all types of both cellulosic and combinations of cellulosic with non-cellulosic fibers. The cellulosic fibers that may be used include, for example, sulfate (Kraft), sulfite, soda, neutral sulfite semi-chemical (NSSC), thermomechanical (TMP), chemi-thermo-mechanical (CTMP), groundwood (GWD), and any combination of these fibers. Any of the foregoing cellulosic fibers may be bleached or unbleached. These designations refer to wood pulp fibers that have been prepared by any of a variety of processes that are typically used in the pulp and paper industry. In addition, synthetic fibers of the viscose rayon or regenerated cellulose type may also be used.

All types of pigments and fillers may be added to the paper that is to be sized using the methods and compositions of this invention. Such materials include, for example, clay, talc, titanium dioxide, calcium carbonate, calcium sulfate, and diatomaceous earths. Other additives, including, for example, alum, as well as other sizing agents, may also be included in the present methods and compositions.

The amount of sizing composition that may be employed to size paper may vary depending, for example, on the particular sizing composition employed, the particular pulp involved, the specific operating conditions, the contemplated end-use of the paper, and the like. Typical concentrations of the sizing composition, based on the dry weight of the pulp in the finished sheet or web, may range from about 0.25 to about 20 pounds per ton (lb/ton). In an embodiment, the sizing composition may be employed at a concentration of from about 0.5 to about 10 lb/ton, with a concentration of from about 1 to about 5 lb/ton being more preferred and a concentration of from about 1 to about 2 lb/ton being still more preferred.

If the sizing composition is used in combination with a cationic emulsifying agent, the concentration of cationic emulsifying agent may vary depending, for example, on the particular sizing composition employed, the particular cationic agent employed, the particular pulp involved, the specific operating conditions, the contemplated end-use of the paper, and the like. Typical concentrations of the cationic agent used range from about 0.1 to about 5.0 parts per 1.0 part of sizing composition.

The foregoing may be better understood by reference to the following examples, which are presented for purposes of illustration and are not intended to limit the scope of the invention.

EXAMPLE 1

Preparation Of An Alkenyl Succinic Anhydride Compound From Succinic Anhydride And A Symmetrical $C_{22}$ Internal Olefin.

To the cup of a 600-mL Parr bomb reactor equipped with a reactor head fitted with a magnetically coupled stir motor connected to a stirring shaft having two angled flat blade impellers, a thermocouple, a thin wall tube which reaches near the bottom of the reactor connected to an exterior needle valve (for reactor content sampling), a flow through valve (for nitrogen purge), a safety rupture disc, a pressure gauge (up to 60 psi), and a needle valve for pressure release is added 250 g (0.8102 moles) of 11-docosene and 0.49 g of a stabilizing additive (BHT in most cases). The mixture is stirred to dissolve the additive into the hydrocarbon. Maleic acid (MA) briquettes (66.20 g, 0.6751 moles) are carefully placed into the Parr cup. The cup is gently warmed in order to melt the MA. The reactor head is then bolted onto the cup and the Parr assembly is placed into its heating mantle. The temperature of the mixture is then raised to 60° C. and maintained for about 30 minutes while purging with nitrogen. After the purge is complete, the reaction vessel is sealed and the temperature is raised to about 225° C. over a period of approximately 20-30 minutes. The reactor is held at this temperature for about 6-8 hours. During this time the reaction temperature and reaction pressure vs. time is recorded. If needed small aliquots are removed from the reactor using the sample tube described above. Heating is then stopped, the reactor vessel cooled, the reactor head is removed and the contents are poured out.

The reaction product prepared above is passed through a 100 mesh filter screen to remove any insoluble impurities and transferred to a vacuum distillation apparatus. The liquid and the distillation apparatus are purged with nitrogen for about 30 minutes and the liquid is distilled at a pressure between about 2 and 0.5 Torr and a temperature of up to about 225-230° C., or when the calculated amount of residual olefin is removed, such that the final product contains less than 3% residual olefin. The distillation pot is allowed to cool to room temperature under a nitrogen blanket and then is poured through a 100 mesh filter screen and sealed in a collection jar. The overall yield of product after distillation is typically 70-80% (assuming <3% residual olefin in the product).

EXAMPLE 2

Sizing Performance In Gypsum Wallboard Liner.

Sizing is important in gypsum wallboard liner to facilitate the manufacture of the finished board and meet end-use requirements. To prepare the wallboard liner, calcium sulfate slurry is sandwiched between two paper-based boards. The drying of the calcium sulfate slurry results in the contact of the paper with hot liquid and steam. The paper liners must be resistant to penetration by the hot water. Also, the outside of the top liner must have a small amount of sizing to control the penetration of paint into the board.

The sizing performances of both a $C_{18}$ symmetrical olefin-based ASA and a $C_{22}$ symmetrical olefin-based ASA are compared to commercial ASA products in a simulated gypsum wallboard liner furnish. The ASA products tested are:

ASA-1: Commercially available ASA from Nalco Company, Naperville, Ill. produced using an ene reaction between maleic anhydride and an isomerized, predominantly $C_{18}$, internal olefin. This product contains 1% (by weight) surfactant to aid in emulsification.

ASA-2: ASA produced using an ene reaction between maleic anhydride and an isomerized, $C_{20}$-$C_{24}$ blend, internal olefin. This product contains 1% (by weight) surfactant to aid in emulsification.

ASA-3: Symmetrical ASA produced using an ene reaction between maleic anhydride and 9-octadecene. The 9-octadecene is produced through a metathesis reaction at Materia, Pasadena, Calif. This product contains 1% (by weight) surfactant to aid in emulsification.

ASA-4: Symmetrical ASA produced using an ene reaction between maleic anhydride and 11-docosene, as described in Example 1. The 11-docosene is produced through a metathesis reaction at Materia, Pasadena, Calif. This product contains 1% (by weight) surfactant to aid in emulsification.

The ASA products are prepared for testing by adding 28 g of ASA to 28 g of cationic polymer (20% solids, cationic, acrylamide-based solution polymer, available from Nalco Company, Naperville, Ill.) and 224 g tap water in a 300 ml capacity Oster® blender cup. The mixture is then agitated at high speed for 90 seconds using an Osterizer® blender. The particle size of each emulsion is measured by laser light scattering using the Malvern Mastersizer Micro from Malvern Instruments Ltd. The volume-based median particle size of each ASA emulsion is approximately 1 μm.

The paper furnish used for testing is prepared as a 50/50 by weight blend of OCC (Nalco shipping boxes) and ONP (Chicago Tribune newspapers). Each furnish is repulped separately at 1.5% consistency in tap water for 20 minutes using a laboratory disintegrator. The two furnishes are combined and diluted with tap water to a consistency of 0.5%.

Handsheets are prepared by mixing 600 ml of 0.5% consistency furnish at 800 rpm in a Dynamic Drainage Jar with the bottom screen covered by a solid sheet of plastic to prevent drainage. The Dynamic Drainage Jar and mixer are available from Paper Chemistry Consulting Laboratory, Inc., Carmel, N.Y. At the start of the mixing time, 10 lb/ton alum (dry basis) is added to the furnish, followed by the addition of the desired amount and type of ASA at 15 seconds, followed by the addition of 0.13 lb/ton (pounds active polymer per ton of dry paper) cationic polymer flocculant (very high molecular weight cationic acrylamide copolymer with a theoretical charge density of 1.20 meq/g, available from Nalco Company, Naperville, Ill.) at 30 seconds. Mixing is stopped at 60 seconds and the furnish is transferred into the deckle box of a Noble & Wood handsheet mold. An 8"×8" handsheet is formed by drainage through a 100 mesh forming wire. The handsheet is couched from the sheet mold wire by placing two blotters and a metal plate on the wet handsheet and roll-pressing with six passes of a 25 lb metal roller. The forming wire and one blotter are removed and the handsheet is placed between two new blotters and the press felt and pressed at 50 psig using a roll press. All of the blotters are removed and the handsheet is dried (top side facing the dryer surface) on a rotary drum drier set at 220° F. for 106 seconds (10% setting). The average air-dry weight of a handsheet is 3.06 g, corresponding to an average basis weight of 73 gsm. The handsheet mold, roll press, and rotary drum dryer are available from Adirondack Machine Company, Glens Falls, N.Y.

Size testing for water resistance is conducted using the Hercules Size Test with #2 ink and an 80% reflectance endpoint, as described in TAPPI Method T 530 om-02. Two measurements are conducted on the wire side of each sheet and the average is reported in Table 1.

Comparison of the sizing results for ASA-1 and ASA-3 shows that having the double bond positioned exactly in the center of the $C_{18}$ olefin prior to reaction with maleic anhydride results in an ASA with dramatically improved sizing efficiency and effectiveness compared to a typical commercial ASA prepared from isomerized $C_{18}$ olefin. Comparison of the sizing results for ASA-3 and ASA4 demonstrates that increasing the length of the symmetrical olefin from $C_{18}$ to $C_{22}$ results in a dramatic improvement in sizing efficiency and effectiveness. The use of ASA-4 in place of the typical commercial product, ASA-1, results in almost a 600% improvement in sizing effectiveness or a 50% reduction in the amount of sizing necessary to achieve an HST of 200 seconds.

TABLE 1

Comparison of the sizing performance of the symmetrical ASA samples compared to ASA products produced from isomerized olefins.

| ASA Type | Dose (lb/ton) | HST (s) |
|---|---|---|
| 1 | 2.0 | 98 |
| | 3.0 | 188 |
| | 4.0 | 285 |
| | 9.0 | 402 |
| | 14.0 | 214 |
| 2 | 2.0 | 127 |
| | 3.0 | 276 |
| | 4.0 | 483 |
| | 9.0 | 643 |
| | 14.0 | 568 |
| 3 | 1.0 | 34 |
| | 2.0 | 145 |
| | 3.0 | 346 |
| | 4.0 | 603 |
| | 9.0 | 1046 |
| | 14.0 | 1070 |
| 4 | 1.0 | 44 |
| | 2.5 | 408 |
| | 4.0 | 1067 |
| | 9.0 | 2098 |
| | 14.0 | 2383 |

EXAMPLE 3

Sizing Performance In A Simulated Liquid Packaging Board Furnish.

The sizing performance of a $C_{22}$ symmetrical olefin-based ASA is compared to that of a commercial ASA and a commercial AKD in a simulated liquid packaging board furnish. In this example ASA-1 and ASA-4 are as defined above. Hercon® 79 is a cationic AKD dispersion sizing product available from Hercules, Wilmington, Del. It is assumed to contain 10% AKD solids for comparison purposes.

The ASA products are prepared for testing by emulsification in water and HI-CAT® 145 cationic potato starch, available from Roquette, Lestrem, France. The HI-CAT® 145 is cooked in a jet cooker (available from Equipment Specialists, Inc., Taylorville, Ill.) for 60 seconds at 266° F. to a solids concentration of 6% prior to emulsification. Each ASA is emulsified by adding 28 g of ASA to 187 g of 6% HI-CAT®

145 and 65 g deionized water in a 300 ml capacity Oster® blender cup. This mixture is agitated at high speed for 90 seconds using an Osterizer® blender.

The particle size of each emulsion is measured by laser light scattering using the Malvern Mastersizer Micro from Malvern Instruments Ltd., UK. The volume-based median particle size of ASA 1 emulsion is 1.07 μm and that of the ASA 4 emulsion is 1.10 μm. The emulsions are post-diluted with deionized water to yield an ASA concentration of 0.46%.

The paper furmish used for testing is prepared by slushing dry lap, bleached hardwood and softwood Kraft pulps. Each pulp is refined in a Valley Beater (from Voith Sulzer, Appleton, Wis.) until a specified freeness is obtained. The hardwood is refined to a freeness of 300 ml CSF and the softwood is refined to a freeness of 470 ml CSF. The two furnishes are combined in a ratio of 70% hardwood to 30% softwood. This pulp is diluted with tap water to a consistency of 1.02% and 0.12 g/l of sodium bicarbonate is added to give a pH of 7.5.

Handsheets are prepared by mixing 680 ml of 1.02% consistency funmish at 1100 rpm in a Dynamic Drainage Jar with the bottom screen covered by a solid sheet of plastic to prevent drainage. The Dynamic Drainage Jar and mixer are available from Paper Chemistry Consulting Laboratory, Inc., Carmel, N.Y. At the start of the mixing time, 1 lb/ton on a solids basis of 25% solids wet strength resin (Amres 25-HP, available from Georgia-Pacific Resins, Inc.) is added to the furnish, followed by the addition of 10 lb/ton alum (dry basis) at 15 seconds, the desired amount (2, 4, or 6 lb/ton) and type of ASA or AKD (solids basis) and 16 lb/ton HI-CAT® 145 starch (solids basis) at 30 seconds, and 1.2 lb/t on a solids basis of an 11% solids borosilicate microparticle, available from Nalco Company, Naperville, Ill., at 45 seconds.

Mixing is stopped at 60 seconds and the furmish is transferred into the deckle box of a Noble & Wood handsheet mold. The 8"×8" handsheet is formed by drainage through a 100 mesh forming wire. The handsheet is couched from the sheet mold wire by placing three blotters and a metal plate on the wet handsheet and roll-pressing with six passes of a 25 lb metal roller. The forming wire and one blotter are removed and the handsheet is placed between two new blotters and the press felt and pressed at 60 psig using a roll press. All of the blotters are removed and the handsheet is dried for 200 seconds (top side facing the dryer surface) using two passes on a rotary drum drier set at 220° F. The average basis weight of a handsheet is 183 g/m$^2$ and the average caliper is 262 μm. The handsheet mold, roll press, and rotary drum dryer are available from Adirondack Machine Company, Glens Falls, N.Y. Three replicate handsheets are produced for each experimental condition tested.

Size testing for lactic acid resistance to edge penetration (REP) is conducted. A 1.5 inch by 3.5 inch rectangular section is cut from every handsheet. This section is laminated using a cold laminating machine (model LS950 available from 3M Corporation, St. Paul, Minn.) between two plastic films with pressure-sensitive adhesive on one side (model DL951 available from 3M Corporation, St. Paul, Minn.). It is trimmed to a size of 1 inch by 3 inches and pressed in the roll press used for handsheet making at 60 psig between two blotter papers. This is done to increase the adhesion between the sheet and the plastic film. The section is weighed and soaked at room temperature in ajar of 1% lactic acid for 24 hours. It is removed from the jar, blotted to remove exterior moisture, and weighed again to determine the amount of liquid that had wicked into it. The results are reported as kilograms of wicked solution per square meter of sample edge area (product of perimeter and caliper). Hot hydrogen peroxide REP is measured in a manner similar to that for lactic acid REP. However, the samples are immersed in a 35% solution of hydrogen peroxide at 70° C. for 10 minutes. The testing results are reported in Table 2.

TABLE 2

Comparison of the liquid packaging board sizing performance of ASA produced from a $C_{22}$ symmetrical olefin, commercial ASA produced from isomerized olefins and AKD.

| | Dose | Lactic Acid REP[2]) | | Peroxide REP[2]) | |
|---|---|---|---|---|---|
| Size | (lb/ton) | Mean | Standard | Mean | Standard |
| 4 | 2 | 4.47 | 0.04 | 3.79 | 0.15 |
| | 4 | 3.69 | 0.18 | 2.50 | 0.15 |
| | 6 | 2.87 | 0.13 | 2.16 | 0.11 |
| 5[1] | 2 | 4.70 | 0.23 | 4.58 | 0.08 |
| | 4 | 3.22 | 0.04 | 2.34 | 0.07 |
| | 6 | 2.24 | 0.07 | 1.59 | 0.17 |
| 1 | 2 | 8.46 | 0.20 | 4.41 | 0.23 |
| | 4 | 7.42 | 0.10 | 3.39 | 0.02 |
| | 6 | 7.16 | 0.07 | 3.38 | 0.08 |

[1]Alkyl ketene dimer (AKD) size available from Hercules, Wilmington, DE under the tradename Hercon ® 79.

Comparison of the sizing results for ASA-1 and ASA-4 shows that the ASA of this invention prepared from a symmetrical $C_{22}$ olefin provides significantly improved lactic acid and peroxide resistance to the board compared to a typical commercial ASA. The ASA of the invention provides lactic acid and peroxide resistance to the board that is approximately equal to that of AKD.

EXAMPLE 4

Sizing Performance In A Simulated Folding Carton Or Cup Stock Furnish.

The sizing performance of a $C_{22}$ symmetrical olefin-based ASA is compared to that of a commercial ASA and a commercial cationic rosin size in a simulated folding carton or cup stock furnish. A typical commercial sizing program for folding carton is 4-7 lb/ton rosin size used with alum in an alum to rosin ratio based on solids of 2:1 up to 4:1. A typical commercial sizing program for cup stock is 10-20 lb/ton rosin size used with alum in an alum to rosin ratio based on solids of 2:1 up to 4:1. In this example ASA-1 and ASA-4 are as defined above. NeuRoz® 426 is a cationic rosin size dispersion product available from Plasmine Technology, Inc., Pensacola, Fla. It is assumed to contain 33% rosin solids for comparison purposes.

The ASA products are prepared for testing by emulsification in water and Amylofax® HS-A cationic potato starch, available from Avebe, Foxhol, The Netherlands. The Amylofax® HS-A is cooked in a jet cooker (available from Equipment Specialists, Inc., Taylorville, Ill.) for 60 seconds at 266° F. to a solids concentration of 6.48% prior to emulsification. Each ASA is emulsified by adding 28 g of ASA to 173 g of 6.48% Amylofax® HS-A and 79 g deionized water in a 300 ml capacity Oster® blender cup. This mixture is agitated at high speed for 120 seconds using an Osterizer® blender.

The particle size of each emulsion is measured by laser light scattering using the Malvern Mastersizer Micro from Malvern Instruments Ltd., UK. The volume-based median particle size of ASA 1 emulsion is 0.70 μm and that of the ASA 4 emulsion is 0.86 μm. The emulsions are post-diluted with deionized water and 6.48% starch solution to yield an ASA concentration of 0.29% and a starch to ASA ratio of 1.5:1. The NeuRoz® 426 was also diluted with deionized water to a rosin solids level of 0.29% prior to use.

The paper furnish used for testing is prepared by slushing dry lap, bleached hardwood and softwood Kraft pulps. Each pulp is refined in a Valley Beater (from Voith Sulzer, Appleton, Wis.) until a freeness of 450 ml CSF is obtained. The two furnishes are combined in a ratio of 70% hardwood to 30% softwood. This pulp is diluted with tap water to a consistency of 0.93% and a small amount of sulfuric acid is added to give a pH of 6.0.

Handsheets are prepared by mixing 615 ml of 0.93% consistency furnish at 1100 rpm in a Dynamic Drainage Jar with the bottom screen covered by a solid sheet of plastic to prevent drainage. The Dynamic Drainage Jar and mixer are available from Paper Chemistry Consulting Laboratory, Inc., Carmel, N.Y. At the start of the mixing time, alum, size, and starch is added to the furnish. When 2, 4, or 6 lb/ton ASA is used, 12 lb/ton alum is added. When 4 or 8 lb/ton rosin is used, 16 lb/ton alum is added and when 12 or 16 lb/ton rosin is used, 32 lb/ton alum is added. The total starch addition for each experiment is 12 lb/ton. When ASA is used, starch is already present in the emulsion. Therefore, additional starch was added to bring the total starch dose to 12 lb/ton. After 15 seconds mixing, 0.39 lb/ton on a solids basis of cationic flocculant (very high molecular weight cationic acrylamide copolymer with a theoretical charge density of 1.20 meq/g, available from Nalco Company, Naperville, Ill.) is added, followed by 1.2 lb/ton of borosilicate microparticle (available from Nalco Company, Naperville, Ill.) at 30 seconds. The addition of alum in these experiments reduces the pH of the furnish to less than 5. (All doses used are in lb active solids per ton of paper produced.)

Mixing is stopped at 45 seconds and the furnish is transferred into the deckle box of a Noble & Wood handsheet mold. The 8"×8" handsheet is formed by drainage through a 100 mesh forming wire. The handsheet is couched from the sheet mold wire by placing three blotters and a metal plate on the wet handsheet and roll-pressing with six passes of a 25 lb metal roller. The forming wire and one blotter are removed and the handsheet is placed between two new blotters and the press felt and pressed at 50 psig using a roll press. All of the blotters are removed and the handsheet is dried for 95 seconds (top side facing the dryer surface) on a rotary drum drier set at 220° F. The average basis weight of a handsheet is 135 g/m$^2$ (30 lb/1000 ft$^2$) and the average caliper is 225 μm. The handsheet mold, roll press, and rotary drum dryer are available from Adirondack Machine Company, Glens Falls, N.Y. Three replicate handsheets are produced for each experimental condition tested.

Size testing for water resistance is conducted using the Hercules Size Test according to TAPPI Method T 530 om-02 with 40% formic acid ink and a 70% reflectance endpoint. Two measurements are conducted on the wire side of each sheet and the average and standard error (S.E.) from three sheets are reported in Table 3.

TABLE 3

Comparison of the folding carton and cup stock sizing performance of ASA produced from a $C_{22}$ symmetrical olefin, commercial ASA produced from isomerized olefins and cationic rosin.

| Size | | Alum | HST (s) | |
|---|---|---|---|---|
| Number | Dose (lb/ton) | (lb/ton) | Mean | S.E. |
| 4 | 2 | 12 | 278 | 32.3 |
| | 4 | 12 | 305 | 17.3 |
| | 6 | 12 | 270 | 5.9 |
| | 8 | 12 | 246 | 6.0 |

TABLE 3-continued

Comparison of the folding carton and cup stock sizing performance of ASA produced from a $C_{22}$ symmetrical olefin, commercial ASA produced from isomerized olefins and cationic rosin.

| Size | | Alum | HST (s) | |
|---|---|---|---|---|
| Number | Dose (lb/ton) | (lb/ton) | Mean | S.E. |
| 1 | 2 | 12 | 48 | 2.0 |
| | 4 | 12 | 78 | 1.1 |
| | 6 | 12 | 82 | 3.6 |
| | 8 | 12 | 60 | 1.5 |
| 6[1] | 4 | 16 | 54 | 5.5 |
| | 8 | 16 | 179 | 1.9 |
| | 12 | 32 | 251 | 1.2 |
| | 16 | 32 | 325 | 0.4 |

[1]Cationic rosin size dispersion available from Plasmine, Technology, Inc., Pensacola, FL under the tradename NeuRoz ® 426.

Comparison of the sizing results for ASA-1 and ASA-4 shows that the ASA of this invention prepared from a symmetrical $C_{22}$ olefin provides significantly improved resistance to acid ink penetration compared to a typical commercial ASA. The acid ink resistance of the board is comparable for both the ASA of the invention and the commercial program of cationic rosin size. However, the ASA of the invention is approximately 400% more efficient in providing this resistance. The commercial ASA (ASA-1) is unable to provide the necessary level of acid resistance to the board.

Changes can be made in the composition, operation and arrangement of the method of the invention described herein without departing from the concept and scope of the invention as defined in the claims.

The invention claimed is:

1. A method of preparing paper having improved resistance to penetration by liquids comprising incorporating in the paper a size composition comprising an alkenyl succinic anhydride compound prepared from the reaction of maleic anhydride with 11-docosene.

2. The method of claim 1 wherein the alkenyl succinic anhydride compounds are incorporated into the paper by adding the alkenyl succinic anhydride compounds to an aqueous cellulosic papermaking slurry.

3. A sized paper product prepared according to the method of claim 2.

4. The method of claim 1 wherein the alkenyl succinic anhydride compounds are incorporated into the paper by applying to the surface of dry paper.

5. A sized paper produtt prepared according to the method of claim 4.

6. The method of claim 1 wherein the alkenyl succinic anhydride compounds are incorporated into the paper by spraying on the surface of the sheet after formation of the wet web.

7. A sized paper product prepared according to the method of claim 6.

8. The method of claim 1 wherein the paper is selected from the group consisting of gypsum wall board liner, boxboard, liquid packaging board, folding carton, cup stock, sack paper, molded paper products, newspaper and printing paper.

9. The method of claim 1 wherein the paper is liquid packaging board.

10. The method of claim 1 wherein the paper is gypsum wall board liner.

11. The method of claim 1 wherein the paper is folding carton.

12. The method of claim 1 wherein the paper is cup stock.

* * * * *